US010240113B2

(12) United States Patent
Heppert et al.

(10) Patent No.: US 10,240,113 B2
(45) **Date of Patent: *Mar. 26, 2019**

(54) DYED COATED BLEACH MATERIALS

(71) Applicant: Reckitt Benckiser Finish B.V., Hoofddorp (NL)

(72) Inventors: Kai Heppert, Ludwigshafen (DE); Jorg Pflug, Ludwigshafen (DE); Claudia Schmaelzle, Ludwigshafen (DE)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 11 days.

This patent is subject to a terminal disclaimer.

(21) Appl. No.: 15/648,117

(22) Filed: Jul. 12, 2017

(65) Prior Publication Data

US 2017/0321171 A1 Nov. 9, 2017

Related U.S. Application Data

(63) Continuation of application No. 13/988,291, filed as application No. PCT/GB2011/052255 on Nov. 18, 2011, now Pat. No. 9,796,954.

(30) Foreign Application Priority Data

Nov. 19, 2010 (GB) ..... 1019628.5

(51) Int. Cl.

| | |
|---|---|
| ***C11D 17/00*** | (2006.01) |
| ***C11D 3/22*** | (2006.01) |
| ***C11D 3/39*** | (2006.01) |
| ***C11D 3/40*** | (2006.01) |

(52) U.S. Cl.

CPC ..... *C11D 17/0039* (2013.01); *C11D 3/221* (2013.01); *C11D 3/3945* (2013.01); *C11D 3/40* (2013.01)

(58) Field of Classification Search

CPC ..... C11D 3/221; C11D 17/00

See application file for complete search history.

(56) References Cited

U.S. PATENT DOCUMENTS

| | | | | |
|---|---|---|---|---|
| 3,650,961 | A | 3/1972 | Hudson | |
| 4,124,734 | A * | 11/1978 | Alterman | C01B 11/06 252/186.36 |
| 4,762,637 | A | 8/1988 | Aronson et al. | |
| 4,863,632 | A | 9/1989 | Aronson et al. | |
| 4,867,895 | A * | 9/1989 | Choy | C11D 3/30 252/186.34 |
| 5,977,053 | A | 11/1999 | Groth et al. | |
| 6,225,276 | B1 * | 5/2001 | Gassenmeier | C11D 3/0047 510/376 |
| 6,280,912 | B1 * | 8/2001 | Whitesides | G03C 1/7614 430/350 |
| 6,407,052 | B2 * | 6/2002 | Gassenmeier | C11D 3/0047 510/376 |
| 6,492,312 | B1 * | 12/2002 | Pfeiffer | C11D 3/3765 510/221 |
| 2001/0012826 | A1 * | 8/2001 | Gassenmeier | C11D 3/0047 510/375 |
| 2002/0039980 | A1 | 4/2002 | Yamamoto et al. | |
| 2002/0198262 | A1 * | 12/2002 | Yamauchi | A61K 31/195 514/561 |
| 2003/0162726 | A1 * | 8/2003 | Rapp | A23G 3/2092 514/25 |
| 2004/0253357 | A1 * | 12/2004 | De Zarate | A23G 3/0089 426/546 |
| 2007/0027053 | A1 | 2/2007 | Di Bono | |
| 2007/0161535 | A1 | 7/2007 | Orlich et al. | |
| 2009/0258811 | A1 * | 10/2009 | Gitzi | C11D 17/0091 510/224 |
| 2011/0062630 | A1 * | 3/2011 | Honda | A61K 8/731 264/299 |
| 2012/0058927 | A1 * | 3/2012 | Borchers | C11D 3/3932 510/220 |
| 2013/0209644 | A1 * | 8/2013 | Miladinov | A23G 3/0065 426/548 |
| 2014/0057821 | A1 * | 2/2014 | Heppert | C11D 3/221 510/220 |
| 2017/0321171 | A1 * | 11/2017 | Heppert | C11D 17/0039 |

FOREIGN PATENT DOCUMENTS

| | | | | |
|---|---|---|---|---|
| CA | 2377728 | A1 * | 1/2001 | C11D 3/046 |
| CA | 2381810 | A1 * | 3/2001 | A23G 3/26 |
| CA | 2326560 | A1 * | 5/2001 | C11D 3/3942 |
| CA | 2583328 | A1 * | 4/2006 | C23G 3/0063 |
| DE | 19954959 | A1 * | 5/2001 | C11D 3/3942 |
| DE | 102009017722 | A1 | 10/2010 | |
| EP | 0271992 | A2 | 6/1988 | |
| EP | 1735423 | B1 | 6/2008 | |
| EP | 1735422 | B1 | 8/2008 | |
| EP | 1633468 | B1 | 1/2009 | |
| EP | 1633471 | A1 | 3/2009 | |
| GB | 190702461 | A * | 9/1907 | |
| WO | 9501416 | A1 | 1/1995 | |
| WO | WO 9907817 | A1 * | 2/1999 | C11D 3/3902 |
| WO | 2004081161 | A1 | 9/2004 | |
| WO | 2009040545 | A1 | 4/2009 | |

OTHER PUBLICATIONS

International Search Report issued in related International Application No. PCT/GB2011/052255 dated May 9, 2012.

* cited by examiner

*Primary Examiner* — Nicole M. Buie-Hatcher
*Assistant Examiner* — Mohammad Reza Asdjodi
(74) *Attorney, Agent, or Firm* — Troutman Sanders LLP; Ryan Schneider; Chris Davis

(57) ABSTRACT

The invention relates to dyed particles of a bleach material that comprise a coating. The invention also relates to the use of the dyed particles in detergent compositions.

15 Claims, No Drawings

DYED COATED BLEACH MATERIALS

CROSS-REFERENCE TO RELATED APPLICATIONS

This application is a continuation of, and claims the benefit of, U.S. patent application Ser. No. 13/988,291, filed 9 Jul. 2013, which is a US National Stage of International Application No. PCT/GB2011/052255, filed 18 Nov. 2011, which claims the benefit of GB 1019628.5, filed 19 Nov. 2010, all of which are herein fully incorporated by reference.

BACKGROUND

1. Technical Field

The present invention relates to particles comprising, a coating, a dye and a bleach compound. The present invention also relates to methods of making the particles and to compositions comprising the particles. In particular the present invention relates to such particles for use in dishwashing and to dishwashing compositions.

2. Background

It is well known in detergent art to formulate bleaching materials in particulate form, as this considered a convenient form for inclusion in many detergent compositions.

In order to obtain good cleaning performance on bleachable stains, e.g. tea, it is desirable to include a bleach material in detergent compositions which are to be used to remove such stains. In dishwashing, especially automatic dishwashing it is well recognised that performance on bleachable stains is one of the key attributes by which consumers assess the effectiveness of a detergent compositions. However, it is well known in the art that the presence of a bleach material in a detergent composition can lead to instability of the composition especially when bleach-sensitive ingredients such as enzymes and perfumes are present. Furthermore the bleach material is generally susceptible to stability problems e.g. when in contact with moisture and/or above ambient temperatures which can typically result in a loss of performance of the bleach material.

These problems have been dealt with in the prior art by physically separating the unstable components from the rest of the composition. Sometimes this has been by providing separate layers of detergent (for example in a tablet) or compartments where different layers contain different parts of the whole composition, thus separating out components that may react with each other. Alternatively the sensitive materials can be coated with a protective layer that prevents interaction with other components of the composition. Or advantageously, both methods used in combination, for added stability and performance.

EP-A-1,735,422 and EP-A-1,735,423 discloses a coated bleaching agent particle consisting of a core containing a bleaching active ingredient, especially a peroxocarboxylic acid, with a coat of water soluble material surrounding this core (such as PVOH).

EP-A-1,633,468 discloses a method for preparing capsules containing at least one imidoperoxycarboxylic acid by applying an inorganic salt onto the at least one imidoperoxycarboxylic acid in particulate form so that the salt forms a capsule shell around the acid.

EP-A-1,633,471 discloses a method for preparing multilayer capsules containing at least one peroxocarboxylic acid (especially imidoperoxycarboxylic acid) by applying at least two different coating layers each based on at least one polyelectrolyte and/or ionic surfactant.

WO 2004/081161 discloses bleach (PAP) encapsulated with a water soluble coating such as gelatin. This bleach containing capsule is disclosed in combination with a liquid composition inside a water soluble outer container.

Manufacturers have made use of the necessity of multicompartment or multilayer nature of solid detergent compositions to improve the aesthetics of the compositions by providing the different parts or layers in different shapes and colours.

The colour in the composition is provided through the use of chemical dyes. A particular problem that still remains is to effectively colour the portion of the composition that contains the bleaching compound or material. Bleaches, by their very nature, react with chemical dyes and reduce their colour.

On storage, this leads to the colour of the layer fading. This can also be patchy with the colour becoming uneven, more faded in some places than in others. This effect is undesirable as it reduces the aesthetic appeal of the tablet in the eye of the consumer. This is because makes the tablet appear old and less effective. In fact, this interaction does reduce the effectiveness of the tablet composition, at least in part, as a portion of the bleach has already been used up by reacting with the dye.

This reaction has often led to bleaches being stored in non coloured (white) portions of the tablets/pouches.

Despite the progress made in detergent composition stability, no one has yet come up with a way to provide a stable, dyed, bleach component in a detergent composition.

It is the object of this invention to solve this problem.

BRIEF SUMMARY OF THE INVENTION

According to a first aspect of the present invention there is a particle comprising a bleach material, a coating and a dye.

In another aspect of the invention, there is provided a dyed particle comprising:

a core comprising bleach material; and a coating.

In some embodiments, the coating comprises a sugar compound. In certain embodiments, the sugar compound comprises mannitol.

In other embodiments, the bleach material is an organic peracid.

In still other embodiments, the bleach material is 6-phthalimido-peroxy-hexanoic acid (PAP).

In some embodiments, the core further comprises a binder. In certain embodiments, the binder comprises a non reducing sugar. In certain embodiments, the binder is isomalt (6-O-α-D-Glucopyranosyl-D-sorbitol (1,6-GPS)+1-O-α-D-Glucopyranosyl-D-mannitol dehydrate (1,1-GPM).

In other embodiments, the core further comprises a disintegrant. In certain embodiments, the disintegrant comprises a saccharide. In certain embodiments, the disintegrant comprises a soy saccharide.

In some embodiments, the weight ratio of bleach compound:binder is between 60:40 and 95:5.

In other embodiments, the core further comprises a disintegrant, wherein the weight ratio of bleach compound: binder:disintegrant is between 60:30:10 and 92.5:5:2.5.

In some embodiments, dye is located in the coating. In other embodiments, dye is located on the coating.

In other embodiments, the coating comprises two or more layers. In certain embodiments, dye is located in the outer layer of the coating. In certain embodiments, dye is located on the outer layer of the coating.

In still other embodiments, the total weight of coating is between 2.5% and 60% by weight of the particle.

In another aspect, the invention provides a dyed particle comprising: a core comprising: 85-95% by weight of a bleach material comprising at least 60% PAP by weight; 2.5-10% by weight of a binder, comprising isomalt; and 2.5-10% by weight of a disintegrant comprising a soy saccharide; and a coating; wherein the coating comprises mannitol, and wherein the coating comprises between 10 and 20% by weight of the particle core.

In a related aspect, the invention provides a detergent composition comprising at least one dyed particle as described herein.

In some embodiments, the composition is formulated for use in an automatic dishwashing machine.

In other embodiments, the detergent composition comprises one of a gel and a liquid. In still other embodiments, the detergent composition comprises a compressed tablet. In yet other embodiments, the detergent composition comprises one or both of a powder and granules.

In another aspect, the invention provides a contained detergent composition comprising: the detergent composition as described herein; and a container within which the detergent composition is contained.

In some embodiments, the container is a flexible polyvinylalcohol (PVOH) film. In other embodiments, the container is a rigid polyvinylalcohol (PVOH) casing.

These and other objects, features and advantages of the present invention will become more apparent upon reading the following specification in conjunction with the accompanying description and claims.

DETAILED DESCRIPTION OF THE INVENTION

The invention will now be described in more detail.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

As used herein, the term "and/or" may mean "and," it may mean "or," it may mean "exclusive-or," it may mean "one," it may mean "some, but not all," it may mean "neither," and/or it may mean "both." The term "or" is intended to mean an inclusive "or."

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Alternatively, particularly with respect to biological systems or processes, the term can mean within an order of magnitude, preferably within 2-fold, of a value. Where particular values are described in the application and claims, unless otherwise stated, the term "about" is implicit and in this context means within an acceptable error range for the particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, do not denote any order, quantity, or importance, but rather are used to distinguish one element from another.

It is noted that terms like "specifically," "preferably," "typically," "generally," and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

Compositions and Methods of the Invention

It has surprisingly been found that it is possible to prepare a dyed bleach particle, suitable for use in detergent compositions.

The bleach particle is coated with a coating and then treated with a dye or the particle is treated with a coating material that already contains a dye.

Particles

The bleach material may be selected from any conventional bleach material used in detergent compositions. The bleach material preferably comprises at least one inorganic peroxide or organic peracid or a chlorine based bleach including derivatives and salts thereof or mixtures thereof. Most preferred according to the invention are organic peracids and their derivatives/salts.

If at least one inorganic peroxide is used as the bleach material, it preferably comprises a percarbonate, perborate and persulphate and/or hydrogen peroxide including derivatives and salts thereof and mixtures thereof. The sodium and potassium salts of these inorganic peroxides being most preferred, especially the sodium salts. Sodium percarbonate and sodium perborate are most preferred, especially sodium percarbonate.

It is especially preferred according to the present invention that the bleach material comprises at least one organic peracid including derivatives and salts and mixtures thereof. These bleach materials are effective at relatively low temperatures, typically around 30° C. and so do not require the use of a bleach activator or bleach catalyst to boost the bleaching performance. This makes these bleach materials especially preferred for detergent applications on environmental and cost considerations.

Organic peracids suitable according for use in the present invention include all organic peracids traditionally used as bleaches in detergent compositions. Preferred examples include perbenzoic acid and peroxycarboxylic acids especially mono- or diperoxyphthalic acid, 2-octyldiperoxysuccinic acid, diperoxydodecanedicarboxylic acid, diperoxyazelaic acid, 6-phthalimidoperhexanoic acid (PAP) and imidoperoxycarboxylic acid and the derivatives and salts and mixtures thereof. Especially preferred is 6-phthalimidoperhexanoic acid (PAP) and the derivatives and salts and mixtures thereof.

The bleach material may be used in a pure form but it is usually commercially available as a raw material which is a mixture of the bleach active material with carrier materials or other auxiliaries such as suitable compatible materials such as stabilisers for the bleach and fillers. Suitable stabilising materials include materials which are capable of taking up water, e.g., as water of crystallisation, such as sulphates.

A preferred form of PAP is supplied by Solvay Chemicals, Inc., and sold under the Eureco WM1 trade mark. This material is ~70% PAP by weight. The remainder of the material is made up of inert stabilizing compounds.

The bleach material is treated to form particles. This may be via granulation, compaction, pelletizing or extrusion and spheronization.

The bleach material can be formed into particles formed solely of the bleach material, or the bleach material may be mixed with other ingredients prior to particulate formation. The bleach material may be supplied already with other ingredients to provide additional stability or other desirable properties.

The bleach material may be mixed with binders or disintegrants, or a mixture thereof.

The bleach material may also be mixed with further optional ingredients as desired.

The bleach material may comprise a single type of bleach compound, or alternatively, the bleach material may comprise two or more different bleach compounds.

Binders may be used to ensure that the particles can be formed with required mechanical strength, and give volume to low active dose tablets. Any binder that is compatible with the bleaching material may be used to form the particles of the present invention.

A non-limiting list of suitable binders include, saccharides and their derivatives, disaccharides such as sucrose, lactose, polysaccharides and their derivatives: starches, cellulose or modified cellulose such as microcrystalline cellulose and cellulose ethers such as hydroxypropyl cellulose (HPC); Sugar alcohols such as xylitol, sorbitol or maltitol; proteins such as gelatin; and synthetic polymers: polyvinylpyrrolidone (PVP), polyethylene glycol (PEG) and polyvinylalcohol (PVOH).

Particularly preferred binders comprise the group of non reducing sugars. A particularly preferred non reducing sugar to use as a binder for inclusion in the particle of the present invention is Isomalt (6-O-α-D-Glucopyranosyl-D-sorbitol (1,6-GPS)+1-O-α-D-Glucopyranosyl-D-mannitol dehydrate (1,1-GPM).

A particularly preferred source of Isomalt is sold by BENEO Palatinit under the trade name of GalenIQ 800.

A single binder compound may be used, or alternatively a mixture of two or more different binder compounds may be used to form the particles.

If the binder is used, preferred weight ratios of bleach material:binder in the particles are, 97.5:2.5 to 60:40. Preferably the ratio of bleach material:binder is between 95:5 and 80:20, more preferably between 92:8 and 80:20, by weight. These ratios are for the total weight of binder and bleach material, in the event that two or more binders or bleach materials are used.

Or alternatively the binder may be present within the particle from 2.5 to 40% by weight of particle, preferably from 3 to 30% by weight, preferably 5 to 25% and more preferably from 8 to 20% by weight. These weight ratios are for the total weight of binder present, if two or more binders are used.

Disintegrants may be used to ensure that the particles formed have the desired solubility profile.

Non-limiting examples of disintegrants include crosslinked polymers such as crosslinked polyvinylpyrrolidone (crospovidone) and crosslinked sodium carboxymethyl cellulose (croscarmellose sodium). Other disintegrants include the modified starch, sodium starch glycolate, cellulose (e.g. cellulose microcrystalline) and cellulose derivates like Carboxymethylcellulose, hydroxypropyl cellulose, hydroxypropylmethyl cellulose, methyl cellulose.

Polysaccharides can also make effective disintegrants. A particularly preferred disaccharide for use in the present invention is the soy saccharide Emcosoy STS IP from Rettenmaier (JRS).

A single disintegrant compound may be used, or alternatively a mixture of two or more different disintegrant compounds may be used to form the particles.

The disintegrant may be present between 1 and 20% by weight of the particle. Preferably the disintegrant may be present between 2 and 10% by weight of the particle. In the case that two or more disintegrants are used. These weight percentages apply to the total amount of disintegrant.

If a binder and a disintegrant are used with a bleaching material to form the particles of the present invention, the preferred weight ratios of bleach material:binder:disintegrants are 95:2.5:2.5, 90:5:5, 85:10:5, 85:5:10, 75:20:5, 75:15:10, 70:20:10 and 60:30:10.

Other ingredients may also be included in the particles as required. The other ingredients used may be any component found within detergent compositions, especially those used for automatic machine washing. Optional ingredients are discussed in more detail below. Optional ingredients may be present in an amount of between 1-10% by weight of the particle.

Any method known in the art to produce particulates may be used for the purposes of the present invention. For example, the mixture of bleach material and other ingredients may be granulated, or compacted to form pellets, or extruded and then broken up. In particular, if extrudates are formed, it is preferably to spheronize the extrudate. This is because this forms very regular particles that are easier to coat.

The bleach material particle may be in the form of a powder or granular material depending upon its particle size. The bleach material particles of the invention may be of any suitable size.

The term "particle" as used by the present invention may cover a wide range of different sizes. The term particle is broad enough to encompass a large range of sizes. The term particle can encompass compressed pills, pellets and tablets.

The particles of the present invention will be in the range of from 20 microns to 20,000 microns (average mean size), more preferably 200 microns to 15,000 microns, most preferably 500 microns to 10,000 microns, such as 1000 microns to 5000 microns.

If small particles are to be used, then preferably these particles will be spheronized, to form particles of regular shape. This aids the coating step, as regular shapes are simpler to coat.

Coating

The coating may comprise between 2 and 75% by weight of the dyed particles of the present invention. Preferably the coating comprises between 3 and 60% by weight, more preferably between 4% and 50% by weight, more preferably between 5% and 40% and most preferably between 10% and 20% by weight of the dyed particles.

It is preferred that the coating of the present invention at least substantially covers the surface of the particle. By "substantially covers," it is meant that at least 95% of the surface of the particle is covered with the coating. Preferably the coating entirely covers the surface of the particle.

The coating of the present invention is preferably formed from a sugar compound. Any sugar compound may be used. The sugar may be a monosaccharide, disaccharide or a polysaccharide. The sugar used may be a single pure sugar or a combination of two or more different sugars.

Sugar coatings have been found to be particularly beneficial for both the stability of the dye and the stability of the bleach compounds.

It is particularly preferable to use the sugar mannitol, or a combination of mannitol and other sugars. A particularly preferred source of mannitol is supplied by Cargill, under the trade name C*Mannidex.

The coating can be applied to the particles comprising the bleach material by any process known in the art. A preferred method comprises fluidized bed coating. Other possible coating techniques are pan coating, powder coating, compression coating.

The coating may consist essentially of the just the sugar compound or compounds. The coating may also contain other ingredients and additives.

The coating may be at least 60% by weight sugar, preferably at least 70% by weight sugar, more preferably at least 80% by weight sugar and most preferably at least 90% by weight sugar.

The coating may comprise a single layer. Or the coating may comprise two or more different layers. If two or more layers of coating are applied then the two or more layers may comprise the same coating material or they may comprise two more different coating materials.

If two or more different layers are used, then the dye may be included in one or more of the layers.

The coating may comprise the dye within it. Or the dye may be applied to the outside of the coating layer once it has been formed around the particle.

Dye

Any suitable dye may be used with the coating of the present invention. The selection of the dye is not critical to the present invention. A range of dyes have been found to be stable in the particles of the present invention.

A non-limiting example of a dye suitable for use in the present invention is Sanolin Ponceau Red (C.I. Food Red 7, C.I. Acid Red 18), which is sourced from Clariant.

Other dyes from the Sanolin range are also suitable. These include Quinoline Yellow, Violet FBL, Blue EHRL and Pyranine Green. The colour is not important for the invention.

Different dyes may also be used as necessary. Combinations of particles may be used with different colours.

Preferably between 0.05% and 5% by weight of dye is used in the coating, more preferably between 0.5% and 4%, more preferably between 0.75% and 3% and most preferably between 1% and 2% by weight of the coating.

Method of Preparation

The particles of the present invention can be prepared in a number of ways that are well known in the art.

The bleaching material may be granulated, or compacted to form a pellet, or extruded, dried and spheronized to form spheronized pellets. The pellets may also be pressed to form a pill.

The bleaching material may be mixed with binders or additives as desired.

A particularly preferred additive to use as a co-granulent is Isomalt.

If compacted particles are used, it is particularly preferable to mix the bleaching compound with Isomalt and a disintegrant prior to compaction. A particularly preferred disintegrant is a soy saccharide If an extrudate method is used, it is preferable to mix water with the bleaching compound, isomalt and a disintegrant. It is also preferably to spheronize the extrudate.

Other additives may be included as desired.

The coating may be applied by any means known in the art. The coating may be a single layer or a build up of multiple layers.

The coating material may contain the dye within it prior to the coating step, or the dye may be applied to the finished coated particles.

Detergent Compositions Comprising the Particles

The particles of the present invention are particularly suitably for use in detergent compositions. In particular, the dyed particles of the present invention are suitable for detergent compositions used in automatic cleaning machines. These include both laundry cleaning and tableware cleaning machines.

The detergent composition may take any form known in the art. Possible forms include tablets, powders, gels, pastes and liquids. The detergent compositions may also comprise a mixture of two or more forms. For example the composition may comprise a gel component and a free powder component. The particles of the present invention may be contained within the gel portion or the powder portion of the detergent composition, or contained within both portions.

Tablets may be homogeneous of composed of multilayers. If the tablets are multi-layered then different layers may comprise different parts of the detergent composition. This may be done to increase stability or increase performance, or both. The particles of the present invention may be contained within one or more layers of the tablets.

The detergent compositions may be housed in PVOH rigid capsules or film blisters. These PVOH capsules or blisters may have a single compartment or may be multi-compartment.

Multi-compartment blisters or capsules may have different portions of the composition in each compartment, or the same composition in each compartment. The distinct regions/or compartments may contain any proportion of the total amount of ingredients as desired.

The PVOH capsules or film blisters may be filled with tablets, powders, gels, pastes or liquids, or combinations of these.

The detergent compositions may comprise any ingredients known in the art. These may include components such as builders, The builder may be either a phosphorous-containing builder or a phosphorous-free builder as desired.

If phosphorous-containing builders are also to be used it is preferred that mono-phosphates, di-phosphates, tri-polyphosphates or oligomeric-poylphosphates are used. The alkali metal salts of these compounds are preferred, in particular the sodium salts. An especially preferred builder is sodium tripolyphosphate (STPP). Conventional amounts of the phosphorous-containing builders may be used typically in the range of from 15% by weight to 60% by weight, such as from 20% by weight to 50% by weight or from 25% by weight to 40% by weight.

If a phosphorous-free builder is included it is preferably chosen from amino acid based compounds and/or succinate based compounds. The terms "succinate based compound" and "succinic acid based compound" are used interchangeably herein. Conventional amounts of the amino acid based compound and/or succinate based compound may be used typically in the range of from 05% by weight to 80% by weight, such as from 25% by weight to 70% by weight or from 30% by weight to 60% by weight.

Preferred examples of amino acid based compounds which may be used are MGDA (methyl-glycine-diacetic acid, and salts and derivatives thereof) and GLDA (glutamic-N,N-diacetic acid and salts and derivatives thereof). Other suitable builders are described in U.S. Pat. No. 6,426,229 which are incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl) glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N, N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula:

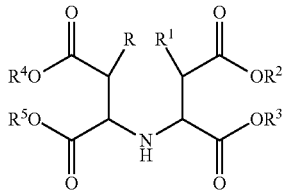

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6 R^7 R^8 R^9 N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms.

Preferred examples include tetrasodium imminosuccinate. Iminodisuccinic acid (IDS) and (hydroxy)iminodisuccinic acid (HIDS) and alkali metal salts or ammonium salts thereof are especially preferred succinate based builder salts.

It is especially preferred according to the present invention that the builder comprises methyl-glycine-diacetic acid, glutamic-N,N-diacetic acid, tetrasodium imminosuccinate, or (hydroxy)iminodisuccinic acid and salts or derivatives thereof.

The phosphorous-free builder may also or alternatively comprise non-polymeric organic molecules with carboxylic group(s). Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred phosphorous-free builder is sodium citrate. Such polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Such polycarboxylates which contain three carboxyl groups include, for example, water-soluble citrate. Correspondingly, a suitable hydroxycarboxylic acid is, for example, citric acid.

Preferably the total amount of builder present is an amount of at least 10% by weight, and most preferably at least 25% by weight, preferably in an amount of up to 70% by weight, preferably up to 40% by weight, more preferably up to 50% by weight. The actual amount used in the compositions will depend upon the nature of the builder used. If desired a combination of phosphorous-containing and phosphorous-free builders may be used.

The detergent compositions may optionally further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the above-mentioned compounds are the ammonium and/or alkali metal salts, i.e. the lithium, sodium, and potassium salts, and particularly preferred salts is the sodium salts. Secondary builders which are organic are preferred. A polymeric polycarboxylic acid is the homopolymer of acrylic acid. Other suitable secondary builders are disclosed in WO 95/01416, to the contents of which express reference is hereby made.

Preferably the total amount of co-builder present is an amount of up to 10% by weight, preferably at least 5% by weight. The actual amount used in the compositions will depend upon the nature of the builder used.

The detergent compositions may also comprise a source of acidity or a source of alkalinity, to obtain the desired pH, on dissolution, especially if the composition is to be used in an automatic dishwashing application. Preferred silicates are sodium silicates such as sodium disilicate, sodium metasilicate and crystalline phyllosilicates. A source of acidity may suitably be any suitable acidic compound for example a polycarboxylic acid. For example a source of alkalinity may be a carbonate or bicarbonate (such as the alkali metal or alkaline earth metal salts). A source of alkalinity may suitably be any suitable basic compound for example any salt of a strong base and a weak acid. When an alkaline composition is desired silicates are amongst the suitable sources of alkalinity.

The detergent compositions may comprise one or more anti-corrosion agents, especially when the detergent compositions are for use in automatic dishwashing operations. These anti-corrosion agents may provide benefits against corrosion of glass and/or metal and the term encompasses agents that are intended to prevent or reduce the tarnishing of non-ferrous metals, in particular of silver and copper.

The detergent compositions may include surfactants. Surfactant may also be included in the shaped body or detergent composition and any of nonionic, anionic, cationic, amphoteric or zwitterionic surface active agents or suitable mixtures thereof may be used. Many such suitable surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred according to the present invention.

Non-ionic surfactants are especially preferred according to the present invention, especially for automatic dishwashing compositions. For laundry and cleaning applications (excluding automatic dishwashing) other surfactants such as anionic surfactants are preferably included and suitable types are well known in the art.

A preferred class of nonionic surfactants is ethoxylated non-ionic surfactants prepared by the reaction of a mono-hydroxy alkanol or alkylphenol with 6 to 20 carbon atoms. Preferably the surfactants have at least 12 moles particularly preferred at least 16 moles, and still more preferred at least 20 moles, such as at least 25 moles of ethylene oxide per mole of alcohol or alkylphenol.

Particularly preferred non-ionic surfactants are the non-ionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30% by weight, preferably more than 50% by weight, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3$ H, methyl or ethyl is particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention for instance mixtures of alkoxylated alcohols and hydroxy group containing alkoxylated alcohols.

Other suitable surfactants are disclosed in WO 1995/001416, to the contents of which express reference is hereby made.

Preferably the non-ionic surfactants are present in the shaped body or the detergent composition in an amount of from 0.1% to 20% by weight, more preferably 1% to 15% by weight, most preferably 2% to 10% by weight, based on the total weight of the detergent composition.

The detergent compositions may also include enzymes. It is preferred that the enzyme is selected from proteases, lipases, amylases, cellulases and peroxidases, with proteases and amylases, especially proteases being most preferred. It is most preferred that protease and/or amylase enzymes are included in the compositions according to the invention as such enzymes are especially effective for example in dishwashing detergent compositions. Any suitable species of these enzymes may be used as desired. More than one species may be used.

The detergent compositions may also comprise bleach additives or bleach activation catalysts. The composition may preferably comprise one or more bleach activators or bleach catalysts depending upon the nature of the bleaching compound. Any suitable bleach activator may be included, for example TAED, if this is desired for the activation of the bleach material. Any suitable bleach catalyst may be used for example manganese acetate or dinuclear manganese complexes such as those described in EP-A-1,741,774. The organic peracids such as perbenzoic acid and peroxycarboxylic acids, e.g., PAP, do not require the use of a bleach activator or catalyst as these bleaches are active at relatively low temperatures such as about 30° C. and this contributes to such bleach materials being especially preferred according to the present invention.

Water may be included in the shaped body or detergent composition.

The detergent compositions may also comprise a source of acidity or a source of alkalinity, to obtain the desired pH, on dissolution, especially if the composition is to be used in an automatic dishwashing application. Preferred silicates are sodium silicates such as sodium disilicate, sodium metasilicate and crystalline phyllosilicates. A source of acidity may suitably be any suitable acidic compound for example a polycarboxylic acid. For example a source of alkalinity may be a carbonate or bicarbonate (such as the alkali metal or alkaline earth metal salts). A source of alkalinity may suitably be any suitable basic compound for example any salt of a strong base and a weak acid. When an alkaline composition is desired silicates are amongst the suitable sources of alkalinity.

The detergent compositions may comprise one or more anti-corrosion agents, especially when the detergent compositions are for use in automatic dishwashing operations. These anti-corrosion agents may provide benefits against corrosion of glass and/or metal and the term encompasses agents that are intended to prevent or reduce the tarnishing of non-ferrous metals, in particular of silver and copper.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, bismuth, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, Zinc acetate, zinc sulphate and $Ce(NO_3)_3$. Any suitable source of multivalent ions may be used, with the source preferably being chosen from sulphates, carbonates, acetates, gluconates and metal-protein compounds. Zinc salts are specially preferred corrosion inhibitors.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Any conventional amount of the anti-corrosion agents may be included. However, it is preferred that they are present in an total amount of from 0.01% by weight to 5% by weight, preferably 0.05% by weight to 3% by weight, more preferably 0.1% by weight to 2.5% by weight, such as 0.2% by weight to 2% by weight, based on the total weight.

Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allysulphonic acid, methallysulphonic acid, 2-hydroxy-3-(2-propenyloxy) propanesulphonic acid, 2-methyl-2-propenen-1-sulphonic acid, styrenesulphonic acid, vinylsulphonic acid, 3-sulphopropyl acrylate, 3-sulphopropylmethacrylate, sulphomethylacrylamide, sulphomethylmethacrylamide and water soluble salts thereof. Suitable sulphonated polymers are also described in U.S. Pat. No. 5,308,532 and in WO 2005/090541.

When a sulfonated polymer is present, it is preferably present in an amount of at least 0.1% by weight, preferably at least 0.5% by weight, more preferably at least 1% by weight, and most preferably at least 3% by weight, up to 40% by weight, preferably up to 25% by weight, more preferably up to 15% by weight, and most preferably up to 10% by weight.

The detergent composition may also comprise one or more foam control agents. Suitable foam control agents for this purpose are all those conventionally used in this field, such as, for example, silicones and their derivatives and paraffin oil. The foam control agents are preferably present in amounts of 0.5% by weight or less.

The detergent compositions may also comprise minor, conventional, amounts of preservatives.

EXAMPLES

The invention is further demonstrated by the following non limiting examples. The use of these and other examples anywhere in the specification is illustrative only and in no way limits the scope and meaning of the invention or of any exemplified term. Likewise, the invention is not limited to any particular preferred embodiments described here. Indeed, many modifications and variations of the invention may be apparent to those skilled in the art upon reading this specification, and such variations can be made without departing from the invention in spirit or in scope. The invention is therefore to be limited only by the terms of the appended claims along with the full scope of equivalents to which those claims are entitled. Further examples within the scope of the invention will be apparent to the person skilled in the art.

Methods of Preparation

Two different types of particles were prepared comprising;

1) 6-phthalimidoperoxyhexanoic acid (PAP) as the bleach material available as Eureco™ WM1 from Solvay Chemicals and comprising 70-75% by weight active PAP.
2) a mixture of 6-O-α-D-Glucopyranosyl-D-sorbitol (1,6-GPS) and 1-0-A-d-Glucopyranosyl-D-mannitol dehydrate (1,1-GPM) as the binder material known as 'Isomalt' and available from BENEO-Palatinit. GalenlQ™ 800 is used in these examples, and
3) a soy polysaccharide as the disintegrant available as Emcosoy STS IP from J. Rettenmaier & Sohne GmbH.

Example 1 was prepared by firstly mixing the bleach material and the binder material together with the disintegrant, then adding water and mixing, extruding, spheronizing and drying to produce a particulate mixture having the overall formulation as shown in Table 1 below. All percentages are by weight based on the amount of raw material used (not active weight for the PAP) and the total weight of the resultant particulate mixture.

Example 2 was prepared by firstly mixing the bleach material and the binder material together with the disintegrant, then pelletizing to produce a particulate mixture having the overall formulation as shown in Table 1 below. All percentages are by weight based on the amount of raw material used (not active weight for the PAP) and the total weight of the resultant particulate mixture.

The particles in both examples have a diameter of ~1000 microns prior to coating.

TABLE 1

| Raw materials | Example 1 % by weight | Example 2 % by weight |
|---|---|---|
| 6-phthalimido-peroxyhexanoic acid (PAP); Eureco ™ WM1 | 85 | 70 |
| Isomalt (GalenlQ ™ 800) | 10 | 20 |
| Emcosoy STS IP | 5.0 | 10 |

Coating

The two different granules in Table 1 were coated by:

a) a coating comprising mannitol and a red dye. The red dye used was Sanolin Ponceau Red. The amount of dye used was 2% by weight of the mannitol. The total amount of mannitol used to coat the granules was 20% by weight of the granules; or b) the same coating as above where the total amount of the coating was 40% by weight of the granules, to provide six different dyed coated particles shown in Table 2.

TABLE 2

| | Dyed particles | | | |
|---|---|---|---|---|
| | Example 4 | Example 5 | Example 6 | Example 7 |
| Granule body | Ex 1 | Ex 2 | Ex 1 | Ex 2 |
| Coating | (a) | (a) | (b) | (b) |

The examples above are intended to be non-limiting.

The particles can be prepared using many other methods known to the skilled person. The granules of Table 1 may be compacted to form larger particles, prior to coating. Pellets may be made by direct compaction of the ingredients in Table 1. An extrusion process followed by spheronization may also be used to provide suitable particles for coating.

Results

Testing for Colour Stability

The six different dyed particles described above were then tested for colour stability. As a control, granules described in Table 1 above, (prior to coating with the mannitol) were sprayed directly with the same dye.

The dyed particles were then left exposed to 40° C. and 75% relative humidity for 12 weeks.

Samples of all four of the dyed coated particles of the present invention described above retained their original colour after 12 weeks of storage in 40° C./75% r.h. conditions No visible difference could be determined between 12 week old dyed particles and the freshly prepared dyed particles.

The control particles meanwhile discoloured considerably over six weeks. The red colour turning a faint pink colour, with white speckles throughout.

The dyed particles of the present invention after storage for 12 weeks were analysed for active PAP and found to have the same storage stability as the un-dyed coated bleach agent.

Detergent Composition

Two non-limiting examples of a suitable detergent composition for the present invention are given below in Tables 3 and 4.

TABLE 3

| Component | % by weight |
|---|---|
| Powder 1 | |
| Sodium carbonate | 8.0 |
| Dyed coated PAP | 10.0 |
| Sodium Tripolyphosphate (STPP) | 51.5 |
| Powder 2 | |
| Protease granules | 2.0 |
| Amylase granules | 1.5 |
| Sulfonated co-polymer | 10.0 |
| Gel composition | |
| Liquid nonionic surfactant ($C_{11}$-$EO_5$-$PO_5$), | 5.0 |
| Sodium Tripolyphosphate (STPP) | 10.0 |
| PEG 6000 as thickener | 1.5 |
| Statistical EO-PO thickener with mole ratio 4:1 and Mw 12000 g/mol. | 0.5 |
| Total | 100.0 |
| pH (1% by weight in water at 20° C.) | 9.8 |

8.5 g of Powder 1 was placed into a first compartment of the polyvinyl alcohol water soluble capsule. 4.5 g of Powder 2 was placed into a second compartment of the polyvinyl alcohol water soluble capsule. 3.0 g of the gel composition of the invention was placed into a third compartment of the polyvinyl alcohol water soluble capsule. The water soluble filled capsule was then sealed with a Polyvinyl alcohol water soluble film (Solublon PT 75). The capsule weight was 2.5 g. Thus the total filled capsule weight was 18.5 g.

TABLE 4

| Component | % by weight |
|---|---|
| Powder 1 | |
| Sodium carbonate | 12.0 |
| Methyl-glycine-diacetic acid Na-Salt (MGDA) | 21.0 |
| Powder 2 | |
| Methyl-glycine-diacetic acid Na-Salt (MGDA) | 35.0 |
| Protease granules | 2.0 |
| Solid nonionic surfactant ($C_{16}$-$C_{18}$ $EO_{25}$) | 4.0 |
| Amylase granules | 1.5 |
| Anti-corrosion agent (TTA) | 0.5 |
| Sulfonated co-polymer | 10.0 |
| Powder 3 | |
| Dyed coated PAP | 14.0 |
| Total | 100.0 |
| pH (1% by weight in water at 20° C.) | 10.0 |

4.5 g of Powder 1 was placed into a first compartment of the polyvinyl alcohol water soluble capsule. 7.0 g of Powder 2 was placed into a second compartment of the polyvinyl alcohol water soluble capsule. 2.0 g of the dyed coated PAP of the invention was placed into a third compartment of the polyvinyl alcohol water soluble capsule. The water soluble filled capsule was then sealed with a Polyvinyl alcohol water soluble film (Solublon PT 75). The capsule weight was 2.5 g. Thus the total filled capsule weight was 16.0 g.

While several possible embodiments are disclosed above, embodiments of the present invention are not so limited. These exemplary embodiments are not intended to be exhaustive or to unnecessarily limit the scope of the invention, but instead were chosen and described in order to explain the principles of the present invention so that others skilled in the art may practice the invention. Indeed, various modifications of the invention in addition to those described herein will become apparent to those skilled in the art from the foregoing description. Such modifications are intended to fall within the scope of the appended claims. The embodiments of the present invention are also not limited to the particular formulations, process steps, and materials disclosed herein as such formulations, process steps, and materials may vary somewhat. Further, the terminology employed herein is used for the purpose of describing exemplary embodiments only and the terminology is not intended to be limiting since the scope of the various embodiments of the present invention will be limited only by the appended claims and equivalents thereof.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

All patents, applications, publications, test methods, literature, and other materials cited herein are hereby incorporated by reference in their entirety as if physically present in this specification.

The invention claimed is:

1. A dyed particle comprising:

a core comprising:

70-92.5% by weight of a bleach material comprising at least 60% PAP by weight;

5-20% by weight of a binder comprising isomalt; and 2.5-10% by weight of a disintegrant comprising a soy saccharide; and a coating;

wherein the coating comprises mannitol, and wherein the coating comprises between 10 and 20% by weight of the particle core.

2. The dyed particle according to claim 1, wherein dye is located in the coating.

3. The dyed particle according to claim 1, wherein dye is located on the coating.

4. The dyed particle according to claim 1, wherein the coating comprises two or more layers.

5. The dyed particle according to claim 4, wherein dye is located in the outer layer of the coating.

6. The dyed particle according to claim 4, wherein dye is located on the outer layer of the coating.

7. The dyed particle according to claim 1, wherein the total weight of coating is between 2.5% and 60% by weight of the particle.

8. A detergent composition comprising at least one dyed particle of claim 1.

9. A method comprising placing the detergent composition of claim 8 in an automatic dishwashing machine and washing dish wares.

10. The detergent composition according to claim 8, wherein the detergent composition comprises one of a gel and a liquid.

11. The detergent composition according to claim 8, wherein the detergent composition comprises a compressed tablet.

12. The detergent composition according to claim 8, wherein the detergent composition comprises one or both of a powder and granules.

13. A contained detergent composition comprising:

the detergent composition of claim 8; and a container within which the detergent composition is contained.

14. The contained detergent composition according to claim 13, wherein the container is a flexible polyvinylalcohol (PVOH) film.

15. The detergent composition according to claim 13, wherein the container is a rigid polyvinylalcohol (PVOH) casing.

* * * * *